US006209951B1

(12) United States Patent
Han

(10) Patent No.: US 6,209,951 B1
(45) Date of Patent: Apr. 3, 2001

(54) PORTABLE, FOLDABLE CHAIR

(76) Inventor: Sanghwan Han, #1818, Suseo-dong 724, Kangnam-Ku, Seoul 135-220 (KR)

( * ) Notice: Subject to any disclaimer, the term of this patent is extended or adjusted under 35 U.S.C. 154(b) by 0 days.

(21) Appl. No.: 09/416,539

(22) Filed: Oct. 12, 1999

(30) Foreign Application Priority Data

Oct. 29, 1998 (KR) ..... 98-45801
Nov. 12, 1998 (KR) ..... 98-21954
Apr. 22, 1999 (KR) ..... 99-6735

(51) Int. Cl.[7] ..... A47C 4/28

(52) U.S. Cl. ..... 297/45; 297/188.14; 297/411.26; 297/411.43; 297/423.19

(58) Field of Search ..... 297/16.2, 16.1, 297/30, 35, 45, 411.26, 411.43, 411.44, 423.19, 423.39, 423.4, 188.14, 440.11

(56) References Cited

U.S. PATENT DOCUMENTS

| | | | | |
|---|---|---|---|---|
| 80,919 | * | 8/1868 | Cox | 297/423.19 X |
| 490,334 | * | 1/1893 | Behr | 297/411.43 X |
| 503,246 | * | 8/1893 | McQuilen | 297/423.4 X |
| 1,025,819 | * | 5/1912 | Mackneer | 297/423.19 X |
| 1,942,112 | * | 1/1934 | McQuilkin | 297/45 |
| 3,124,387 | * | 3/1964 | Maclaren | 297/16.2 |
| 4,989,836 | * | 2/1991 | Hudson, III et al. | 297/391 |
| 5,797,655 | * | 8/1998 | Mile | 297/188.14 X |
| 5,893,605 | * | 4/1999 | Chang | 297/16.2 X |

FOREIGN PATENT DOCUMENTS

| | | | | |
|---|---|---|---|---|
| 332425 | * | 9/1958 | (CH) | 297/45 |
| 2506661 | * | 9/1975 | (DE) | 297/45 |
| 1017080 | * | 9/1952 | (FR) | 297/45 |

* cited by examiner

*Primary Examiner*—Milton Nelson, Jr.

(74) *Attorney, Agent, or Firm*—Alan Kamrath; Rider Bennett Egan & Arundel, LLP

(57) ABSTRACT

A foldable chair according to the present disclosure comprises a frame 1 comprising four connectors 11*a*, 11*b*, 12*a* and 12*b* for contacting the ground, eight slant supports 16*a*, 16*b*, 17*a*, 17*b*, 17*c*, 17*d*, 17*e* and 17*f* which are hinged with the connectors, two vertical supports 15*a* and 15*b* fixedly jointed to the connectors 11*a* and 11*b*, two front fixing connectors 14*a* and 14*b* fixed to the supports 16*a* and 16*b* and hinged with the supports 17*b* and 17*f*, and two rear sliding connectors 13*a* and 13*b* which slide up and down along the vertical supports 15*a* and 15*b* and are hinged with the supports 17*a*, 17*c* and the supports 17*d* and 17*e*; a seat cloth 2 comprising a pair of eyelets 21*b* and 21*a* for inserting the straight ends 161*a* and 161*b* of the supports 16*a* and 16*b*, respectively, a pair of eyelets 22*a* and 22*b* for inserting the vertical supports 15*a* and 15*b*, a pair of sheaths 23*a*, 23*b* for receiving the inclined ends 151*a* and 151*b*, respectively, and a pair of covers 24*a* and 24*b* for covering the sheaths 23*a* and 23*b*; and a pair of arm rests 5 comprising a belt 52 for rest having eyelet 54 for inserting the vertical support 15*b*, and a cup holder 5 which receives the straight end 161*a* and is fixed to the straight end 161*a* with a bolt. The foldable chair according to the present disclosure can further comprises a leg rest 3 comprising two leg supports 31*a* and 31*b* which are crosswise hinged and hinged with connecting members 35*a* and 35*b*, respectively, a leg cloth 34, a pair of belts 32*a* and 32*b* fixed with the leg cloth, and a pair of hangers 33*a* and 33*b* connected to the belts 32*a* and 32*b*, respectively. The foldable chair of the present disclosure can further comprises a head rest 4 comprising a head support 41, a pair of sheaths 42*a* and 42*b*, and a pair of rods 43*a* and 43*b* which are inserted into the sheaths 42*a* and 42*b*, respectively.

14 Claims, 6 Drawing Sheets

PORTABLE, FOLDABLE CHAIR

FIELD OF THE INVENTION

The present invention relates to a portable, foldable chair. More specifically, the present invention relates to a portable, foldable chair which has a pair of arm rests with cup holders, a leg rest adjustably assembled to the frame, and a head rest adjustably assembled to the frame.

BACKGROUND OF THE INVENTION

A portable, foldable chair is very useful in a garden of a house, or outdoors. In this specification, a portable, foldable chair is called "a foldable chair" hereinafter. A foldable chair is usually assembled with a chair frame made of hollow steel pipes and a seat cloth assembled thereon. Of course, the chair frame can be made of various materials such as hollow plastic pipes or hollow aluminium pipes as well as hollow steel pipes. The seat cloth is a woven fabric of a sufficient strength. The Oxford cloth woven with nylon 6 filament yarn is preferably used for the seat cloth.

Conventional foldable chairs are not comfortable because they consist of a foldable frame and a seat cloth assembled thereon. In other words, conventional foldable chairs are not equipped with a pair of arm rests which would make the user comfortable when seated. Although arm rests are very popular components in regular chairs. In particular, as a foldable chair is used when taking a rest in a garden or outdoors, it is important to equip the foldable chair with a pair of arm rests.

Accordingly, a need exists for a portable, foldable chair which can be used comfortably and conveniently and, which can overcome the drawbacks of conventional foldable chairs.

OBJECTS OF THE INVENTION

An object of the present invention is to provide a foldable chair having a pair of arm rests with a cup holder, which is comfortable and useful.

Another object of the present invention is to provide a foldable chair adjustably assembled with a leg rest which can make the user comfortable by stretching the user's legs when taking a rest.

A further object of the present invention is to provide a foldable chair adjustably assembled with a leg rest which can be easily disassembled from and assembled to the frame of the foldable chair, and is not easily disassembled from the frame during use, in other words, when the foldable chair is unfolded.

A further object of the present invention is to provide a foldable chair further comprising a head rest which is adjustable.

The above and other objects of this invention may be accomplished by the following description of this invention.

SUMMARY OF THE INVENTION

A foldable chair according to the present invention comprises a frame 1 comprising four connectors 11*a*, 11*b*, 12*a* and 12*b* for contacting the ground, eight slant supports 16*a*, 16*b*, 17*a*, 17*b*, 17*c*, 17*d*, 17*e* and 17*f* which are hinged with said connectors, two vertical supports 15*a* and 15*b* fixedly jointed to the connectors 11*a* and 11*b*, two front fixing connectors 14*a* and 14*b* fixed to the supports 16*a* and 16*b* and hinged with the supports 17*b* and 17*f*, and two rear sliding connectors 13*a* and 13*b* which slide up and down along the vertical supports 15*a* and 15*b* and are hinged with the supports 17*a*, 17*c* and the supports 17*d* and 17*e*; a seat cloth 2 comprising a pair of eyelets 21*a* and 21*b* for inserting the straight ends 161*a* and 161*b* of the supports 16*a* and 16*b*, respectively, a pair of eyelets 22*a* and 22*b* for inserting the vertical supports 15*a* and 15*b*, a pair of sheaths 23*a*, 23*b* for receiving the inclined ends 151*a* and 151*b*, respectively, and a pair of covers 24*a* and 24*b* for covering the sheaths 23*a* and 23*b*; and a pair of arm rests 5 comprising a belt 52 for an arm rest having eyelet 54 for inserting the vertical support 15*b*, and a cup holder 51 which receives the straight end 161*a* and is fixed to the straight end 161*a* with a bolt 56.

The foldable chair according to the present invention further comprises a leg rest 3 comprising two leg supports 31*a* and 31*b* which are crosswise hinged and hinged with connecting members 35*a* and 35*b*, respectively, a leg cloth 34, a pair of belts 32*a* and 32*b* fixed with the leg cloth 34, and a pair of hangers 33*a* and 33*b* connected to the belts 32*a* and 32*b*, respectively.

The foldable chair of the present invention further comprises a head rest 4 comprising a head support 41, a pair of sheaths 42*a* and 42*b*, and a pair of rods 43*a* and 43*b* which are inserted into the sheaths 42*a* and 42*b*, respectively. The head rest 4 is adjustably assembled by inserting the rods 43*a* and 43*b* into the inclined ends 151*a* and 151*b* of the vertical supports 51*a* and 51*b*.

The following description explains in detail a portable, foldable chair of the present invention in reference with attached drawings.

DETAILED DESCRIPTION OF THE INVENTION

The present invention relates to a portable, foldable chair which has a pair of arm rests with cup holders, a leg rest adjustably assembled to the frame, and a head rest adjustably assembled to the frame.

Figure 1:
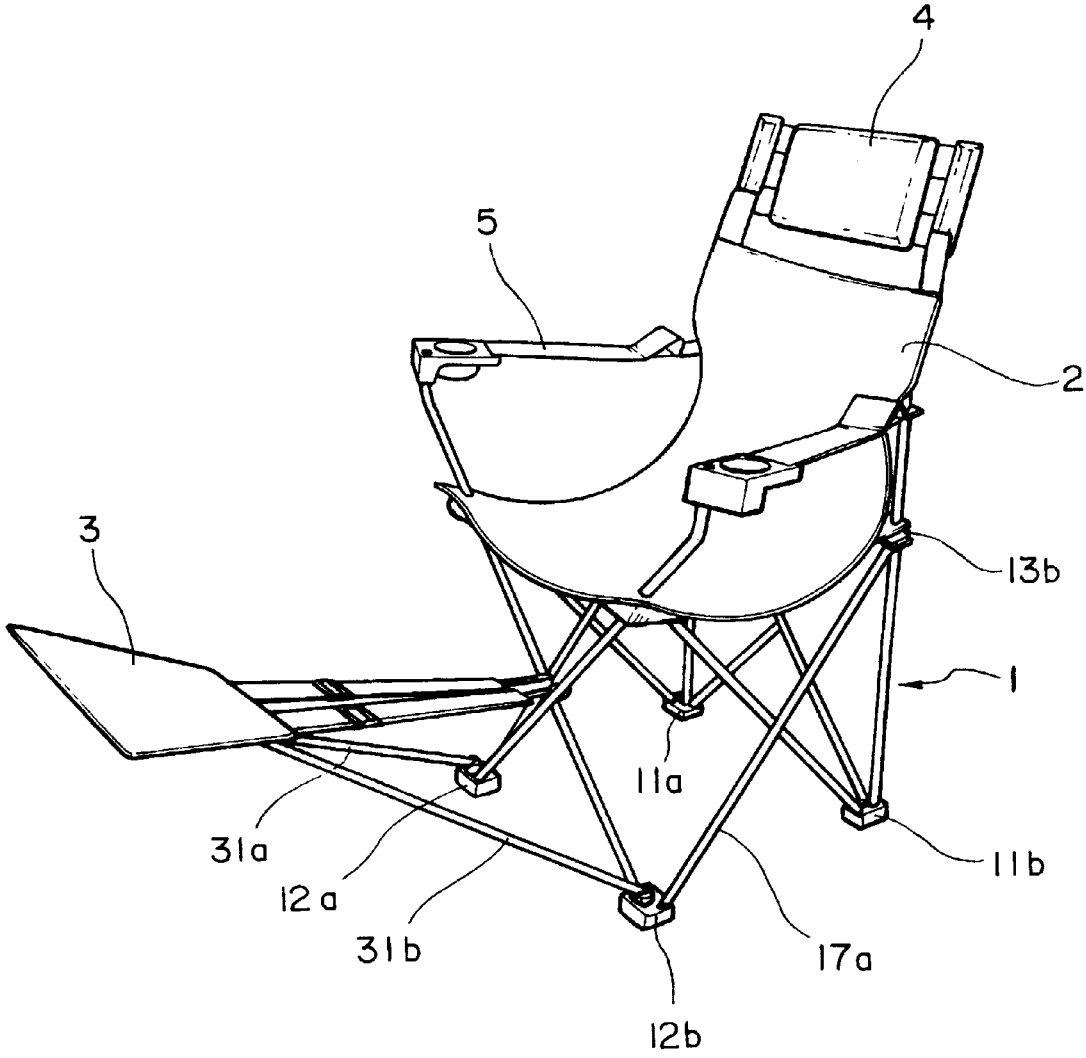
FIG. 1 is a perspective view of a foldable chair in accordance with the present invention.
Figure 2:
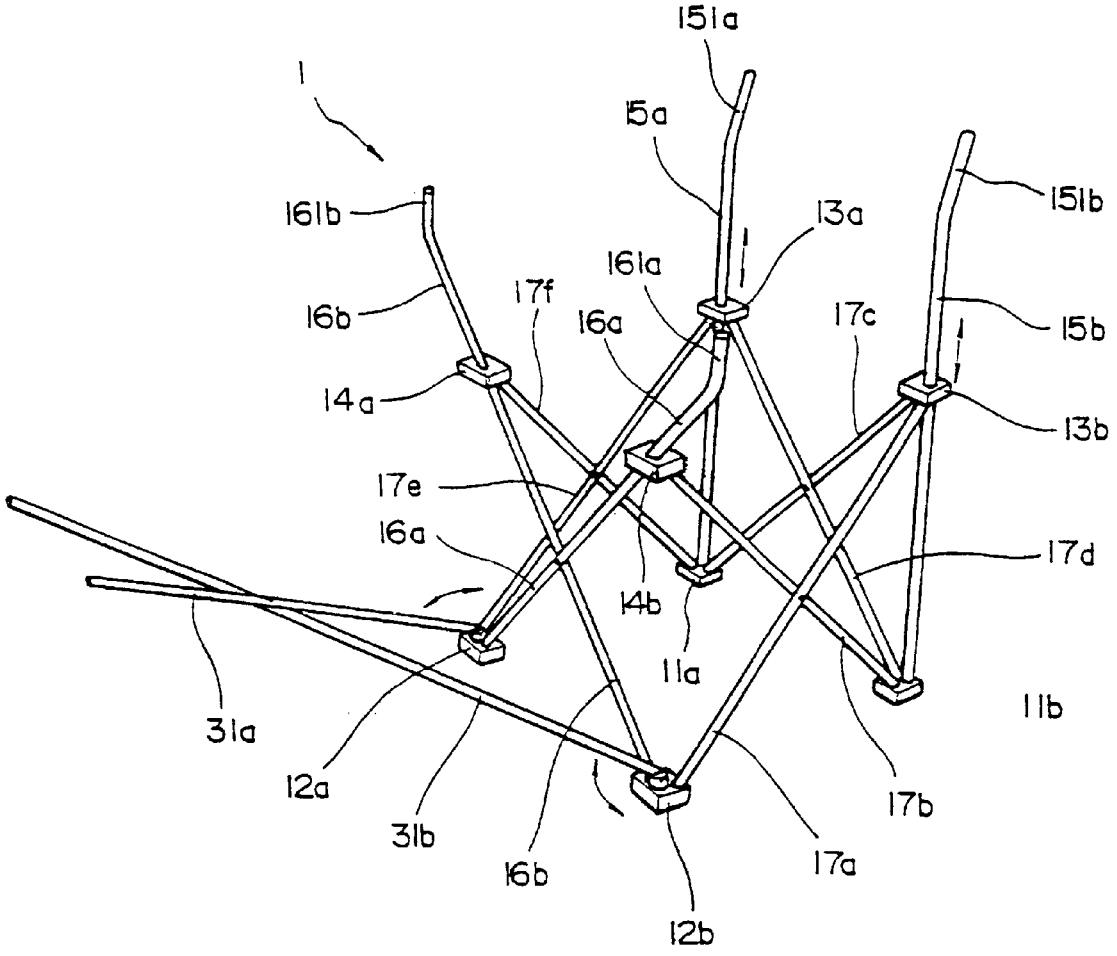
FIG. 2 is a perspective view of a frame of a foldable chair in accordance with the present invention.

FIG. 1 is a perspective view of a portable, foldable chair in accordance with the present invention. The foldable chair comprises a frame 1 made of steel or plastic hollow pipes connected with connectors, a seat cloth 2 assembled with the frame, a pair of arm rests 5 having cup holders 51, a leg rest 3 adjustably assembled to the frame 1, and a head rest 4 adjustably assembled to the rear upper part of the frame 1. FIG. 2 is a perspective view of a frame 1 of a portable, foldable chair in accordance with the present invention. In FIG. 2, leg supports 31*a* and 31*b* for a leg rest 3 are included. The chair frame 1 of FIG. 2 consists of four connectors 11*a*, 11*b*, 12*a* and 12*b* for contacting on the ground, eight slant supports 16*a*, 16*b*, 17*a*, 17*b*, 17*c*, 17*d*, 17*e* and 17*f* which are hinged with said connectors, two vertical supports 15*a* and 15*b* fixedly jointed to the connectors 11*a* and 11*b*, two front fixing connectors 14*a* and 14*b* fixed to the supports 16*a* and 16*b* and hinged with the supports 17*b* and 17*f*, and two rear sliding connectors 13*a* and 13*b* which slide up and down along the vertical supports 15*a* and 15*b* and are hinged with the supports 17*a*, 17*c* and the supports 17*d* and 17*e;*

A rear connector 11*a* is hinged with a rear support 17*c* and a side support 17*f*, and receives a vertical support 15*a* to join fixedly. The vertical support is joined with a bolt (not depicted), which can be easily understood to an ordinary skilled person in the art. A rear connector 11*b* is hinged with a rear support 17*d* and a side support 17*b*, and receives a vertical support 15*b* to join fixedly.

A front connector 12*a* is hinged with a side support 17*e* and a front support 16*a*, and is assembled with or disassembled from a leg support 31*a*. A front connector 12*b* is hinged with a side support 17*a* and a front support 16*b*, and is assembled with or disassembled from a leg support 31*b*.

A front fixing connector 14*a* is fixedly assembled to a front support 16*b*, and is hinged with a side support 17*f*. A front fixing connector 14*b* is fixedly assembled to a front support 16*a*, and is hinged with a side support 17*b*.

A rear sliding connector 13*a* is hinged with a side support 17*e* and a rear support 17*d*, receives a vertical support 15*a*, and slides up and down along the vertical support when folding and unfolding a chair. A rear sliding connector 13*b* is hinged with a side support 17*a* and a rear support 17*c*, receives a vertical support 15*b*, and slides up and down along the vertical support when folding and unfolding a chair.

The front supports 16*a* and 16*b*, side supports 17*a* and 17*b*, rear supports 17*c* and 17*d*, and side supports 17*e* and 17*f* are crosswise hinged with each other at the central part of them and make the chair foldable or unfoldable.

The front supports 16*a* and 16*b* are extended to form straight ends 161*a* and 161*b*, respectively, and the straight ends receive each cup holder 51 and joined together with a bolt 56.

The vertical supports 15*a* and 15*b* are extended to form inclined ends 151*a* and 151*b*, respectively, and the inclined ends receive the rods 43*a* and 43*b* of the head rest 4.

Figure 3:
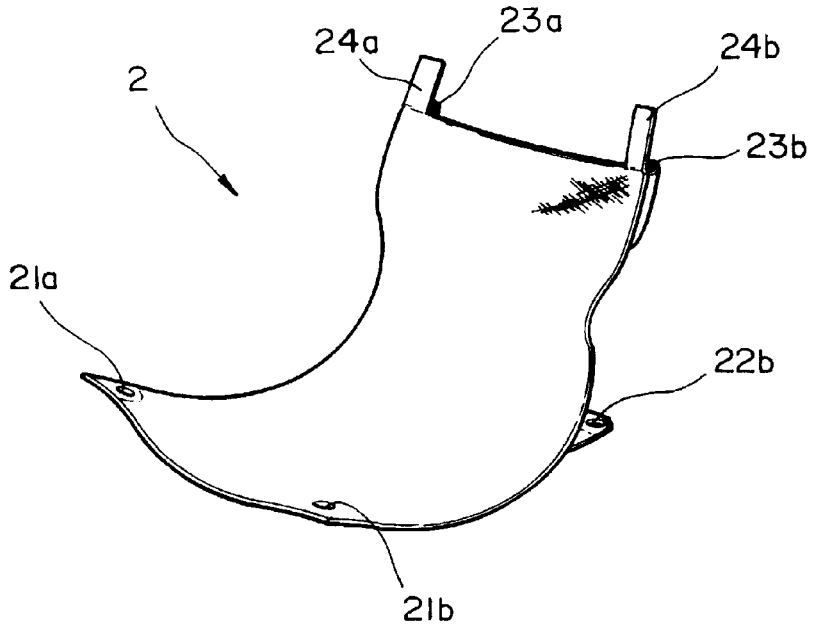
FIG. 3 is a perspective view of a seat cloth to be assembled to the frame of FIG. 2.

FIG. 3 is a perspective view of a seat cloth 2 to be assembled to the frame of FIG. 2.

The seat cloth has a pair of eyelets 21*b*, 21*a* at the front edge for inserting the straight ends 161*a* and 161*b* of the supports 16*a* and 16*b*, respectively, and positioning on the front fixing connectors 14*a* and 14*b*. Cloth covers (not depicted) for covering the front fixing connectors 14*a* and 14*b* can be formed at the lower part of said eyelets 21*b* and 21*a*, respectively.

The seat cloth has a pair of eyelets 22*a* and 22*b* at the rear edge for inserting the vertical supports 15*a* and 15*b*, respectively, and positioning on the rear sliding connectors 13*a* and 13*b*. Cloth covers (not depicted) for covering the rear sliding connectors 13*a* and 13*b* can be formed at the lower part of said eyelets 22*a* and 22*b*, respectively.

Figure 6:
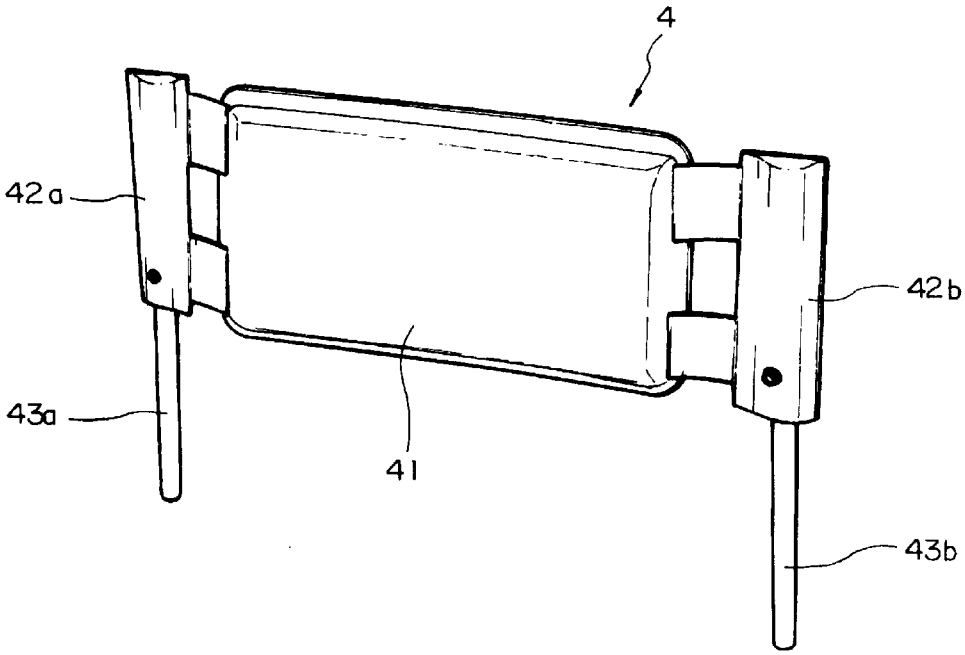
FIG. 6 is a perspective view of a head rest to be assembled to the frame of FIG. 2.

The seat cloth is formed at the upper pedge with a pair of sheaths 23*a* and 23*b* for receiving the inclined ends 151*a* and 151*b*, respectively, and with a pair of covers 24*a* and 24*b* for covering the sheaths 23*a* and 23*b*. A head rest of FIG. 6 is assembled by inserting the rods 43*a* and 43*b* into the hollow pipes of inclined ends 151*a* and 151*b*. When the head rest is not assembled, the covers 24*a* and 24*b* wrap the sheaths 23*a* and 23*b* with a button or velcro.

Figure 4:
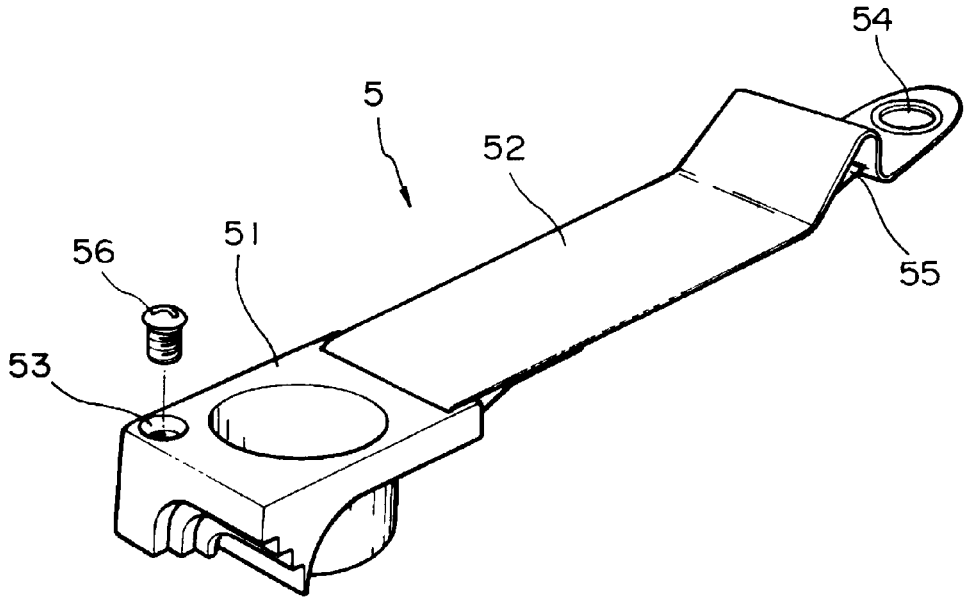
FIG. 4 is a perspective view of an arm rest to be assembled to the frame of FIG. 2.

FIG. 4 is a perspective view of an arm rest 5 to be assembled to a straight end 161*a* and a vertical support 15*b* at the both ends. The arm rest comprises a cup holder 51 and a belt 52. A straight end 161*a* is inserted into the hole 53 of cup holder 51, the hole is assembled with a straight end 161*a* by a bolt 56. An end of belt 52 has an eyelet 54 for inserting a vertical support 15*b* into the eyelet 54. An elastic support 55 is attached to a lower part of a belt 52 to provide the arm rest with elasticity. The cup holder is a molded article manufactured with a resin composition.

Figure 5:
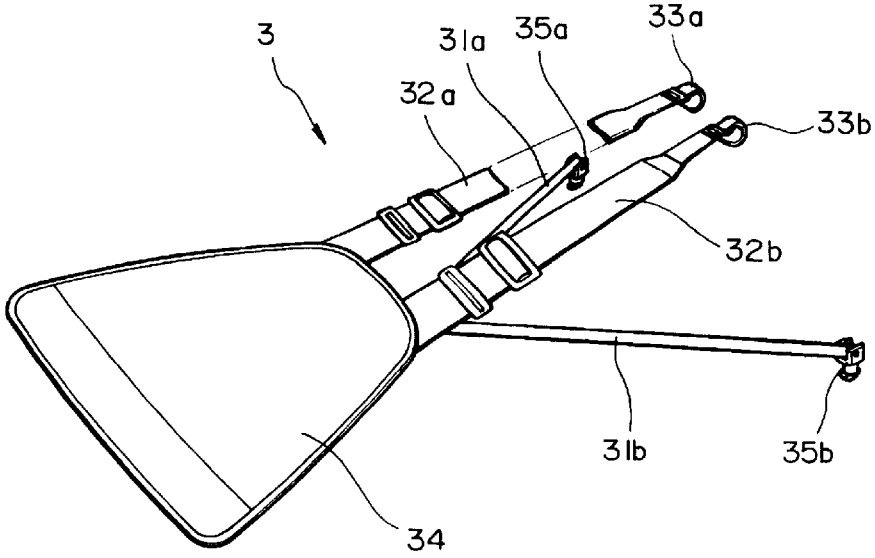
FIG. 5 is a perspective view of a leg rest to be assembled to the frame of FIG. 2.

FIG. 5 is a perspective view of a leg rest 3 which can be additionally assembled to the foldable chair of the present invention. The leg rest comprises two crossingly hinged leg supports 31*a* and 31*b* which are each hinged with connecting members 35*a* and 35*b*, respectively, a leg cloth 34 in which the two leg supports 31*a* and 31*b* are received by each sheath (not depicted); a pair of belts 32*a* and 32*b* connected to said cloth 34; and a pair of hangers 33*a* and 33*b* connected to the belts. Connecting members 35*a* and 35*b* are each assembled to the front connectors 12*a* and 12*b*, respectively. The hangers 33*a* and 33*b* are each assembled to the front supports 16*b* and 16*a*, respectively, which is easily carried out by an ordinary skilled person in the art. The hangers 33*a* and 33*b* are recommended to be made of plastic material with elasticity. A leg cloth 34, like seat cloth 2, is recommended to be made of the Oxford cloth.

FIG. 6 is a perspective view of a head rest 4 to be adjustably assembled to the foldable chair of the present invention. The head rest comprises a head support 41, a pair of sheaths 42*a* and 42*b* which are connected to said head support 41, and a pair of rods 43*a* and 43*b* to be inserted into the sheaths at the one end and to be adjustably inserted into inclined ends 151*a* and 151*b*. A head support 41 can be made cushiony by filling it with material like a sponge.

Figure 7:
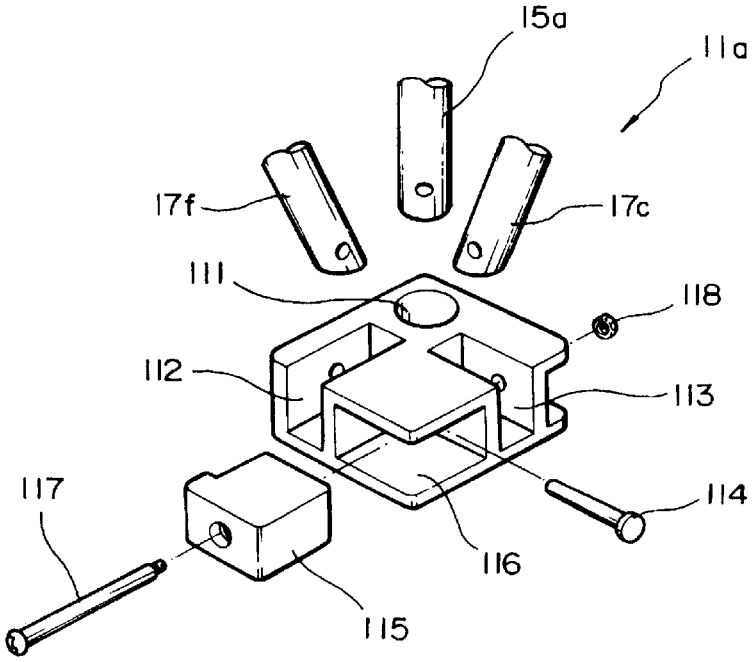
FIG. 7 is a dismantled perspective view of a rear connector 11*a* for a foldable chair of the present invention.

FIG. 7 is a dismantled perspective view of a rear connector 11*a* for a foldable chair of the present invention. A vertical support 15*a* is inserted into the cavity 111 of the rear connector 11*a* and is fixed with a bolt (not illustrated). The side support 17*f* is inserted into the cavity 112 and is hinged with a rivet 114. The rear support 17*c* is inserted into the cavity 113 and is hinged with an inserting member 511, a screw rivet 117 and a bolt 118. The rear connector 11*b* is what a rear connector 11*a* is rotated clockwise by 90°.

Figure 8:
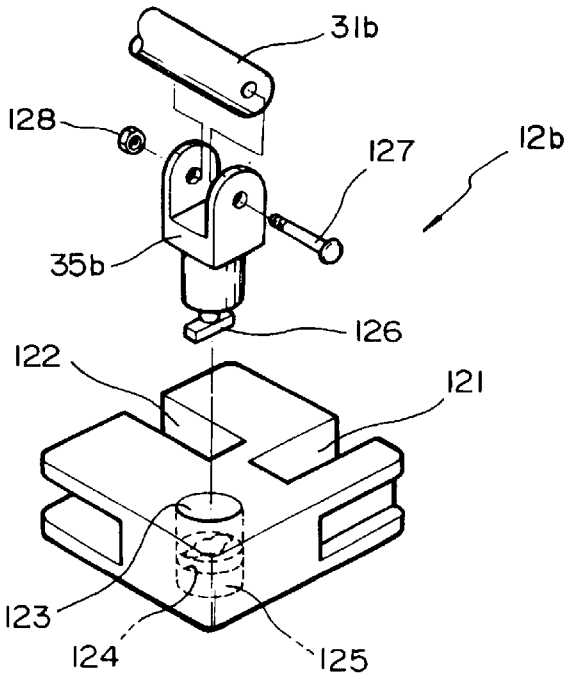
FIG. 8 is a dismantled perspective view of a front connector 12*b* for a foldable chair of the present invention.

FIG. 8 is a dismantled perspective view of a front connector 12*b* for a foldable chair of the present invention. At the cavity 121 of the front connector 12*b* is the side support 17*a* hinged, and at the cavity 122 is the front support 16*b* hinged, and at the cavity 123 is the locking member 126 of the connecting member 35*b* inserted through groove 124. The connecting member 35*b* is hinged with the support 31*b* of the leg rest 3 by a screw rivet 127 and a bolt 128. The locking member 126 of the connecting member 35*b* passes through the groove 124 and reaches to the cavity 125, and then when the leg rest 3 is spread out from the chair, the locking member 126 rotates together with a connecting member 35*b*, and does not align with the groove 124. Accordingly, the leg rest 3 does not separate from the chair while it is spread out from the chair. The operation described above is well shown in FIG. 9 and FIG. 10. The front connector 12*a* is what a front connector 12*b* is rotated clockwise by 90°.

Figure 9:
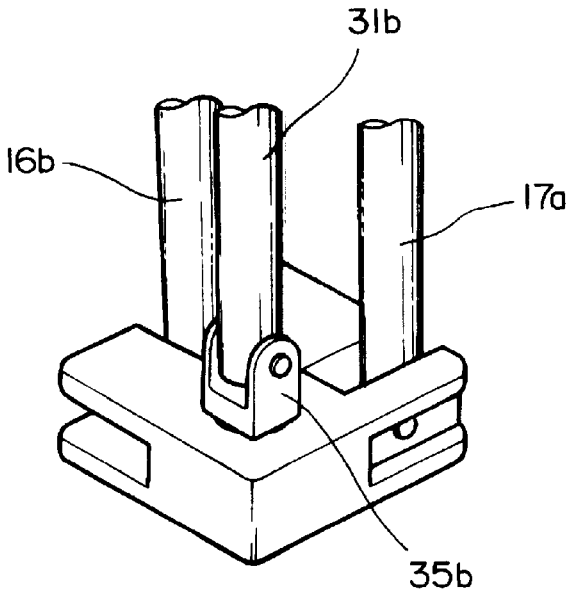
FIG. 9 is a perspective view showing the connection of a front connector 12*b* while the chair frame and the leg rest are folded.

FIG. 9 is a perspective view showing the connection of a front connector 12*b* while the chair frame and the leg rest 3 are folded. The front support 16*b*, side support 17*a*, and leg support 31*b* are assembled to the front connector 12*b*, and they become almost vertical to the front connector 12*b* while the chair is folded. The locking member 126 of the connecting member 35*b* is aligned with the groove 124 of the front connector 12*b* and passes through the groove 124. The front support 16*b*, side support 17*a*, and leg support 31*b* lay obliquely while the chair is unfolded.

Figure 10:
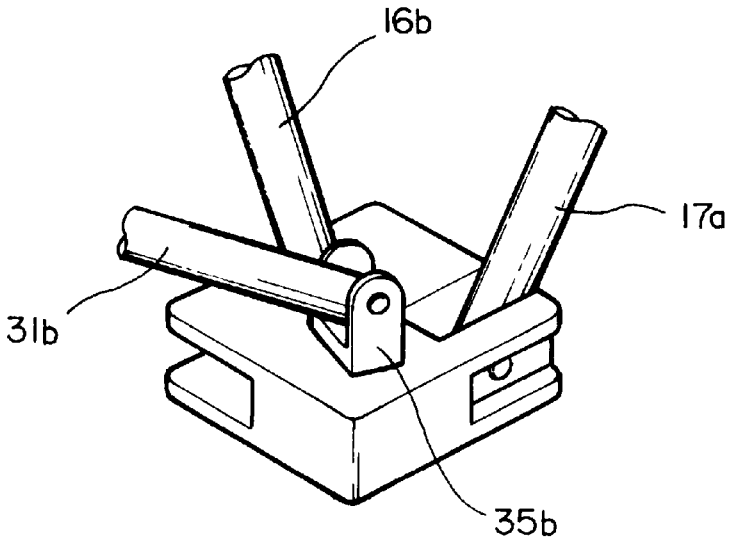
FIG. 10 is a perspective view showing the connection of a front connector 12*b* while the chair frame and the leg rest are unfolded.

FIG. 10 is a perspective view showing the connection of the front connector 12*b* while the chair frame 1 and the leg rest 3 are unfolded. Namely, FIG. 10 is a perspective view of the front connector 12*b* of FIG. 9 when the chair frame and the leg rest are unfolded. The front support 16*b* and side support 17*a* are hinged to lay obliquely. When the support 31*b* is laid obliquely, the connecting member 35*b* hinged with the support 31*b* is rotated clockwise, resulting in the connecting member 35*b* not being separated from the front connector 12*b*. When the support 31*a* is laid obliquely, the connecting member 35*a* (not illustrated) hinged with the support 31*a* is rotated counterclockwise, resulting that the connecting member 35*a* is not separated from the front connector 12*a*. The leg rest 3 is separated from the chair in reverse order of assembly. More specifically, when the frame 1 of the chair is folded, the front support 16*b*, side support 17*a*, and leg support 31*b* become almost perpendicular to the ground, resulting in the locking member 126 aligning with the groove 124 and is easily separating from the groove.

The present invention has an effect of providing a portable, foldable chair to be used comfortably and conveniently with a pair of arm rests equipped with cup holders. The cup holders can be easily modified with various designs by a person skilled in the art. In addition, the present invention gives an effect of easily assembling or disassembling a leg rest or a head rest.

In the above description, the present invention was described based on the preferred embodiment of the present invention, but it should be apparent to those ordinarily skilled in the art that various changes and modifications can be added without departing from the spirit and scope of the present invention. Such changes and/or modifications should come within the scope of the present invention.

What is claimed is:

1. A portable chair comprising, in combination:

a frame including first and second front supports and first and second rear supports;

a seat assembled on the frame and extending between the first and second front supports and the first and second rear supports; and at least a first arm rest comprising a belt assembled to the frame and extending between the first front support and the first rear support, and an elastic support having a first end attached to a first portion of the belt and a second end attached to a second portion of the belt, with the elastic support providing elasticity to the first arm rest.

2. The portable chair as claimed in claim 1, which further comprises a head rest comprising a head support, a pair of sheaths, and a pair of rods inserted into the pair of sheaths, and the head rest is adjustably assembled by inserting the rods into the first and second rear supports.

3. The portable chair as claimed in claim 1 wherein the belt includes an upper side and a lower side, with the elastic support being attached to the lower side of the belt.

4. The portable chair as claimed in claim 1 wherein the belt further includes a rear eyelet for receipt of the first support.

5. The portable chair as claimed in claim 4 wherein the arm rest further includes a cup holder which is fixed to the front support, with the belt extending from the cup holder.

6. The portable chair as claimed in claim 5 wherein the seat is formed from a cloth, and wherein the cloth includes a pair of front eyelets for receipt of the first and second front supports and includes a pair of rear eyelets for receipt of the first and second rear supports.

7. The portable chair as claimed in claim 6 wherein the first and second rear supports each include an upper end, and wherein the cloth further includes a pair of sheaths for receiving the upper ends of the first and second rear supports, with the first and second rear supports being received in the pair of rear eyelets spaced from the upper ends.

8. The portable chair as claimed in claim 7 wherein the seat further includes a pair of covers covering the pair of sheaths.

9. The portable chair as claimed in claim 7 wherein the first and second front supports are slanted and form the shape of an X.

10. A portable, foldable chair comprising, in combination:

a frame;

a seat assembled on the frame; and a leg rest comprising two leg supports having front and rear ends, with the two leg supports being crosswise hinged intermediate the front and rear ends, with the rear ends being hinged with the frame, a leg cloth extending between the front ends, a pair of belts fixed with the leg cloth, and a pair of hangers connected to the pair of belts and connected to the frame.

11. The portable, foldable chair as claimed in claim 10 wherein the seat is formed of cloth.

12. The portable, foldable chair as claimed in claim 10, wherein said rear ends are hinged to the frame by connecting members formed with locking members, and wherein said frame is formed with grooves through which the locking members pass.

13. The portable, foldable chair as claimed in claim 12 wherein the frame includes first and second front supports and includes first and second connectors for contacting the ground, with the first and second front supports being hinged to the first and second connectors, with the grooves being formed in the first and second connectors.

14. The portable, foldable chair as claimed in claim 13 wherein the first and second front supports are slanted and form the shape of an X.

* * * * *